United States Patent [19]

Tomison et al.

[11] 4,207,492

[45] Jun. 10, 1980

[54] SLOW-WAVE HIGH FREQUENCY DEFLECTION STRUCTURE

[75] Inventors: William H. Tomison, Beaverton; Bozidar Janko, Portland; Myron A. Bostwick, Jr., Banks; Aris Silzars, Portland, all of Oreg.

[73] Assignee: Tektronix, Inc., Beaverton, Oreg.

[21] Appl. No.: 931,656

[22] Filed: Aug. 7, 1978

Related U.S. Application Data

[63] Continuation of Ser. No. 802,109, May 31, 1977, abandoned.

[51] Int. Cl.[2] ..... H01J 23/16; H01J 29/96

[52] U.S. Cl. ..... 315/3; 315/3.6; 313/421

[58] Field of Search ..... 315/3, 3.6; 313/421

[56] References Cited

U.S. PATENT DOCUMENTS

| | | | |
|---|---|---|---|
| 3,118,110 | 1/1964 | Spangenberg | 315/7 X |
| 3,504,222 | 3/1970 | Fukushima | 315/3.5 X |
| 3,694,689 | 9/1972 | Odenthal et al. | 315/3 |
| 3,849,695 | 11/1974 | Piazza et al. | 315/3 |

*Primary Examiner*—Saxfield Chatmon, Jr.
*Attorney, Agent, or Firm*—John D. Winkelman

[57] ABSTRACT

An electron beam deflection structure for a high frequency cathode-ray tube incorporates a meanderline slow wave circuit that is supported directly by the same glass rods used to support other portions of the CRT's beam forming and deflection system. To accomplish this, elongate loops that serially interconnect a plurality of deflection plate segments are bent away from the plane of the segments (and the beam axis) and joined by integral support strips to the rods. The elimination of a separate support structure for the deflectors greatly reduces manufacturing costs.

11 Claims, 5 Drawing Figures

SLOW-WAVE HIGH FREQUENCY DEFLECTION STRUCTURE

This is a continuation of application Ser. No. 802,109 filed May 31, 1977 and now abandoned.

BACKGROUND OF THE INVENTION

The present invention relates generally to electron beam deflection structures for electron discharge devices such as cathode-ray tubes, and more particularly to an improved high frequency deflection structure incorporating a slow wave circuit of the meanderline type.

It is well known to incorporate slow wave circuits in electron beam deflection structures for high frequency oscilloscope cathode-ray tubes. Such structures conventionally include a pair of deflection electrodes disposed on opposite sides of the beam path, the electrodes being designed to produce a deflection field that travels along the path in step with the electrons in the beam. The slow wave circuit serves to reduce the deflection signal's travel velocity until it is equal to the velocity of the beam electrons, allowing accurate beam deflection with very high frequency signals.

Prior deflection structures with slow wave circuits include those incorporating helical delay lines, such as the deflectors shown in U.S. Pat. Nos. 3,005,128 to Goldberg et al. and Re. 28,223 to Odenthal et al. While helical deflectors have good performance characteristics, they are relatively complex and expensive to manufacture. Deflectors of a simpler meanderline type are shown in U.S. Pat. Nos. 2,922,074 and 3,174,070 to Moulton and U.S. Pat. No. 3,504,222 to Fukushima.

The meanderline-type deflection structure shown in the Moulton U.S. Pat. No. 2,922,074 includes an elongate slotted deflection plate disposed face-to-face between a pair of similarly-profiled flat metal plates. The deflection plate, which is situated much closer to one of the metal plates than the other, has a plurality of narrow slots projecting inwardly from its opposite edges. The inner ends of the slots overlap to form a plurality of laterally-extending metal strips joined at their outer ends to provide a zigzag path for a deflection signal propagated along the plate. The joined ends of the metal strips terminate in small support tabs, which engage corresponding holes in either of two insulating sheet that support the deflection plate between them. The metal plates are similarly supported between the insulating sheets in suitably spaced relation to the deflection plate, forming a boxlike deflection structure that is mounted within a CRT in a conventional manner. The Moulton U.S. Pat. No. 3,174,070 concerns a similar deflection structure in which a portion of one metal plate is replaced by a section of zigzag deflection plate to provide improved high frequency and transient signal response.

Fukushima describes a class of slow wave structures that include a meanderline of conductive material in the form of a flat serpentine strip. Shielding members are interposed between the loops of the meanderline for the purpose of improving the line's dispersion characteristic. The serpentine strip is mounted above a ground plane in the slow wave structure by means of short pins at the outer ends of its loops. The pins engage holes in insulating plates extending up from the edges of the ground plane. In another embodiment, the meanderline is adhered to the shielding members, which support it above the ground plane. No means for mounting the slow wave structures in a CRT is disclosed.

SUMMARY OF THE INVENTION

According to a preferred embodiment of the present invention, an electron beam deflection structure incorporating a meanderline slow wave circuit is provided in which the meanderline is directly supported by glass rods that may also support other portions of a CRT's beam forming and deflection system. To accomplish this, elongate loops that serially interconnect a plurality of deflection plate segments are bent away from the plane of the segments and joined by integral support strips to the rods.

DETAILED DESCRIPTION

Figure 1:
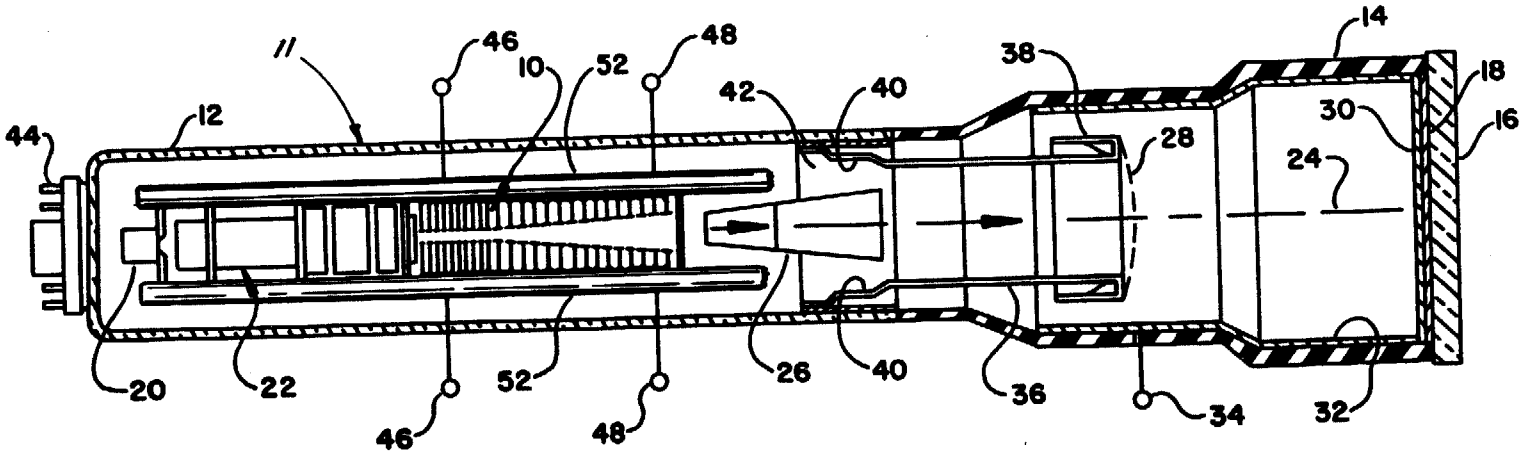
FIG. 1 is a longitudinal section view of a high frequency cathode-ray tube incorporating the electron beam deflection structure of the present invention.

Referring first to FIG. 1, an electron beam deflection structure 10 in accordance with the present invention is contained within the evacuated envelope of an otherwise conventional cathode ray tube 11. The envelope includes a tubular glass neck 12, a ceramic funnel 14, and a transparent glass faceplate 16 sealed together by devitrified glass seals as taught by U.S. Pat. No. 3,207,936 to Wilbanks et al. A layer 18 of a phosphor material is coated on the inner surface of faceplate 16 to form a fluorescent display screen for the CRT. An electron gun 22 including a cathode 20 is supported inside neck 12 at the opposite end of the tube to provide a beam 24 of electrons directed toward the fluorescent screen.

Electron beam 24 is deflected in the vertical direction by deflection structure 10, and in the horizontal direction by a pair of deflection plates 26 (one shown). After such deflection, the electron beam is accelerated by a high potential electrostatic field and strikes the display screen at a high velocity. The post-deflection acceleration (PDA) field is produced between a mesh electrode 28 and a thin, electron transparent aluminum film 30 overlying phosphor layer 18. Film 30 is electrically connected to a conductive layer 32 deposited on the inner surface of funnel 14. The conductive layer terminates at (i.e., to the left in the figure) of mesh electrode 28 as shown, and is connnected through a lead-in connector 34 to an external high voltage DC source (not shown).

Mesh electrode 28 is supported on a metal ring 38 attached to the forward end of a support cylinder 36. A plurality of spring contacts 40 attached to the rear end of the cylinder engage a conductive coating 42 on the inner surface of neck 12. The mesh electrode and support cylinder are electrically connected via base pins 44 to the average potential of horizontal deflection plates 26, i.e., approximately ground potential. This provides a field-free region between electrode 28 and the output ends of the horizontal plates. The various electrodes of gun 22 also are connected to external circuitry through base pins 44. Both the vertical and horizontal deflection structures are connected to external circuitry by neck pins 46, 48 extending through the side of glass neck 12.

Figure 2:
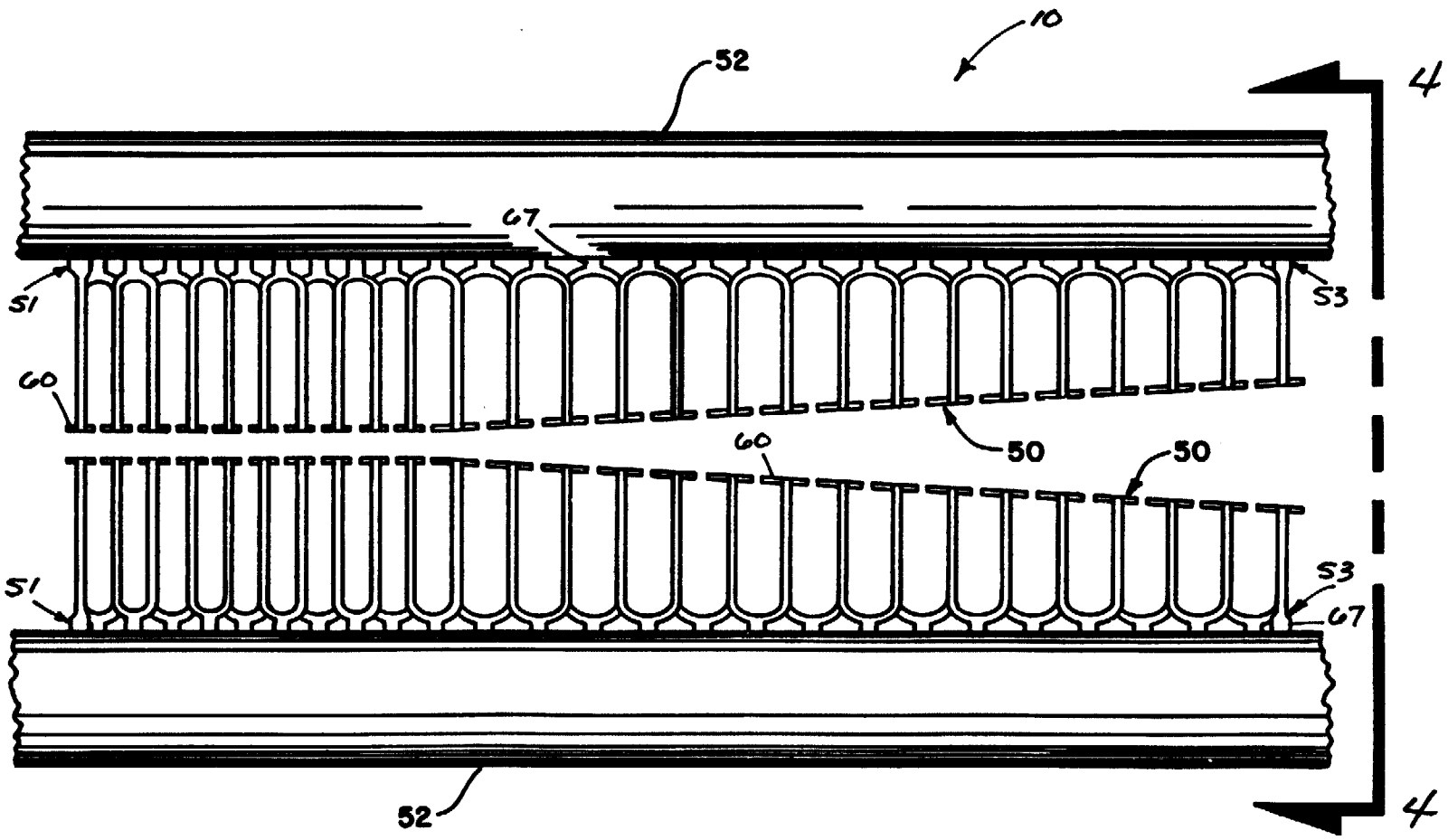
FIG. 2 is an enlarged fragmentary side view of the vertical deflection structure used in the FIG. 1 CRT.
Figure 3:
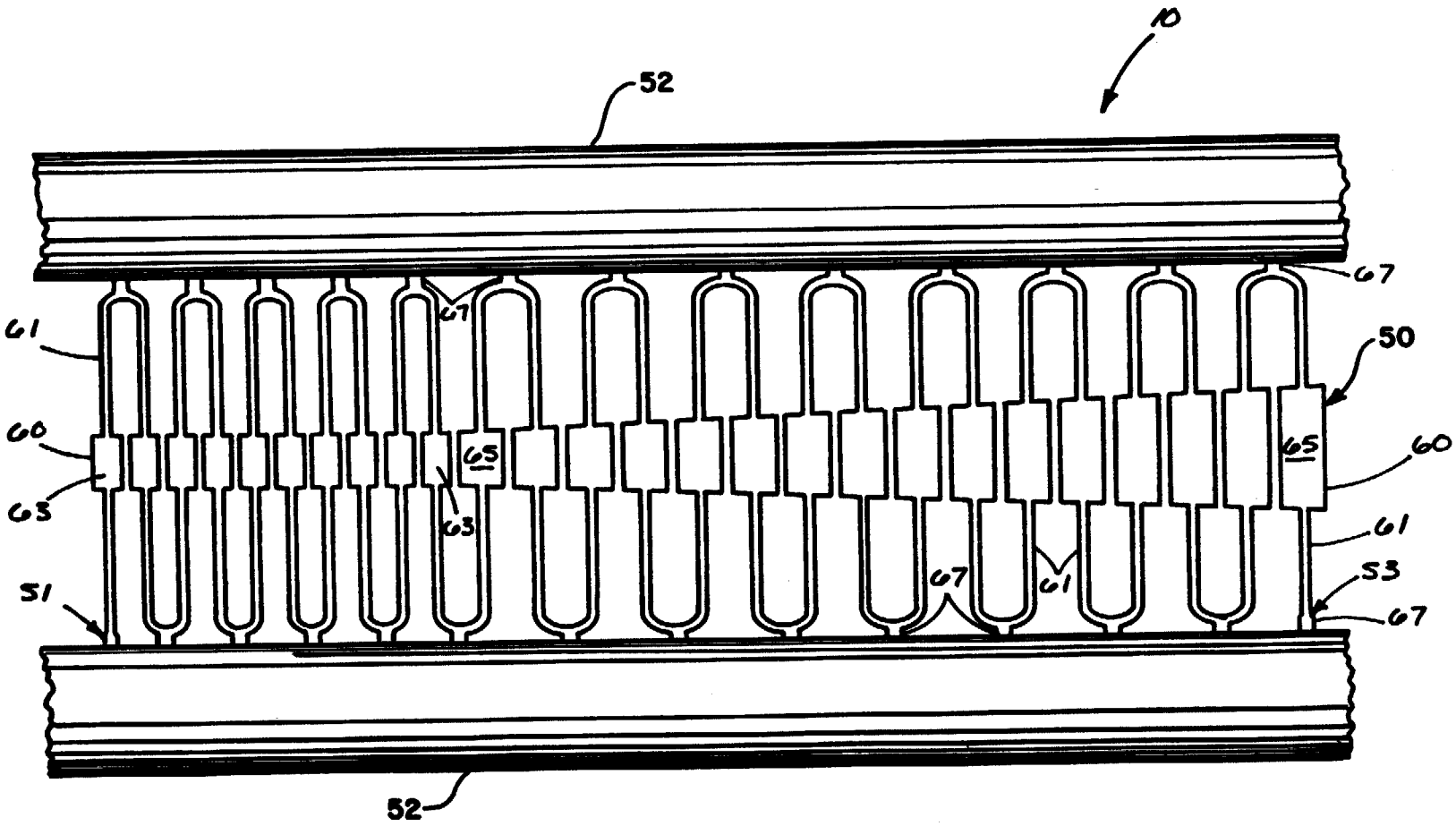
FIG. 3 is an enlarged fragmentary plan view of a mounted meanderline deflection member.
Figure 4:
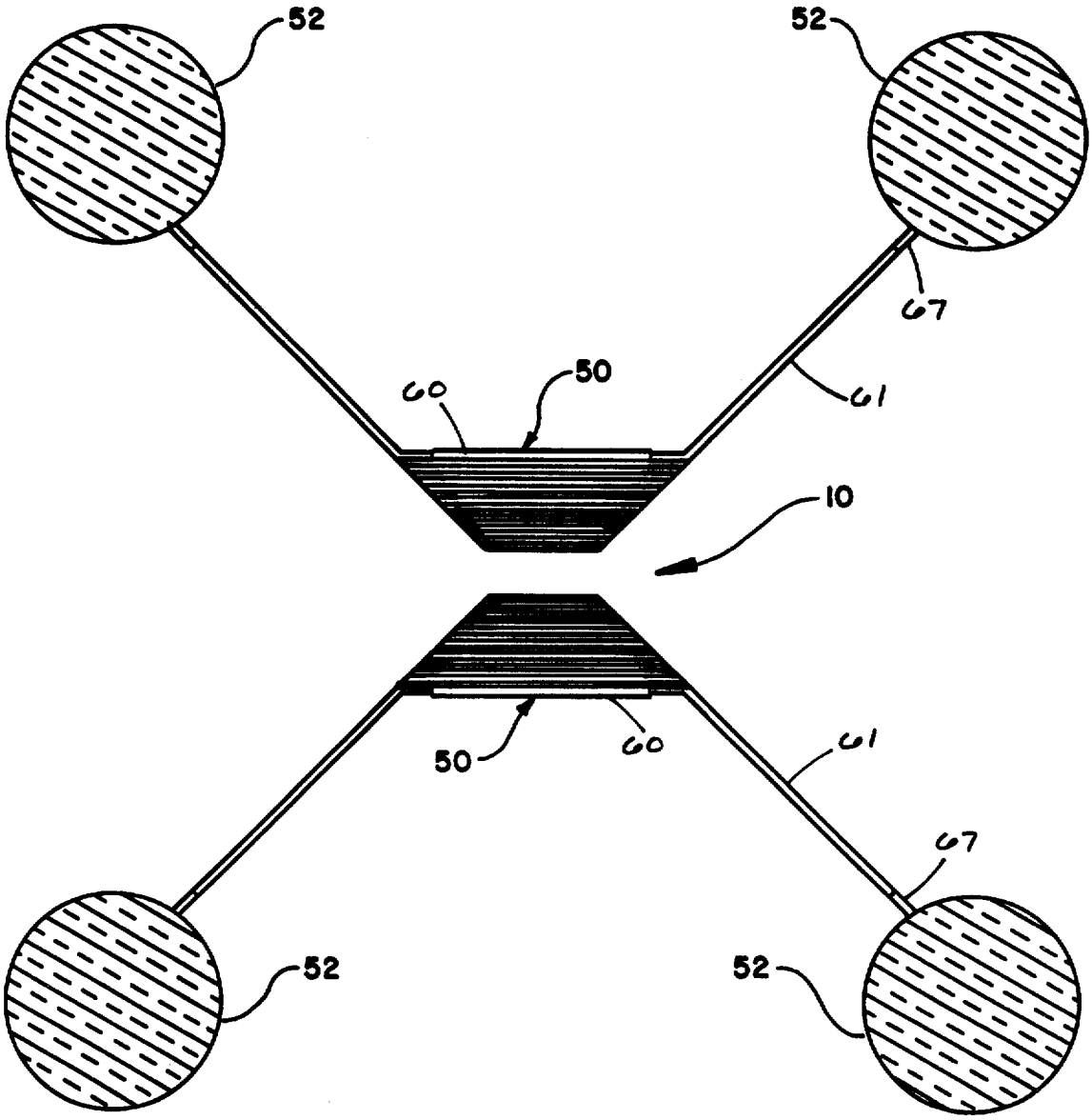
FIG. 4 is an enlarged end view taken along view line 4—4 in FIG. 2.
Figure 5:
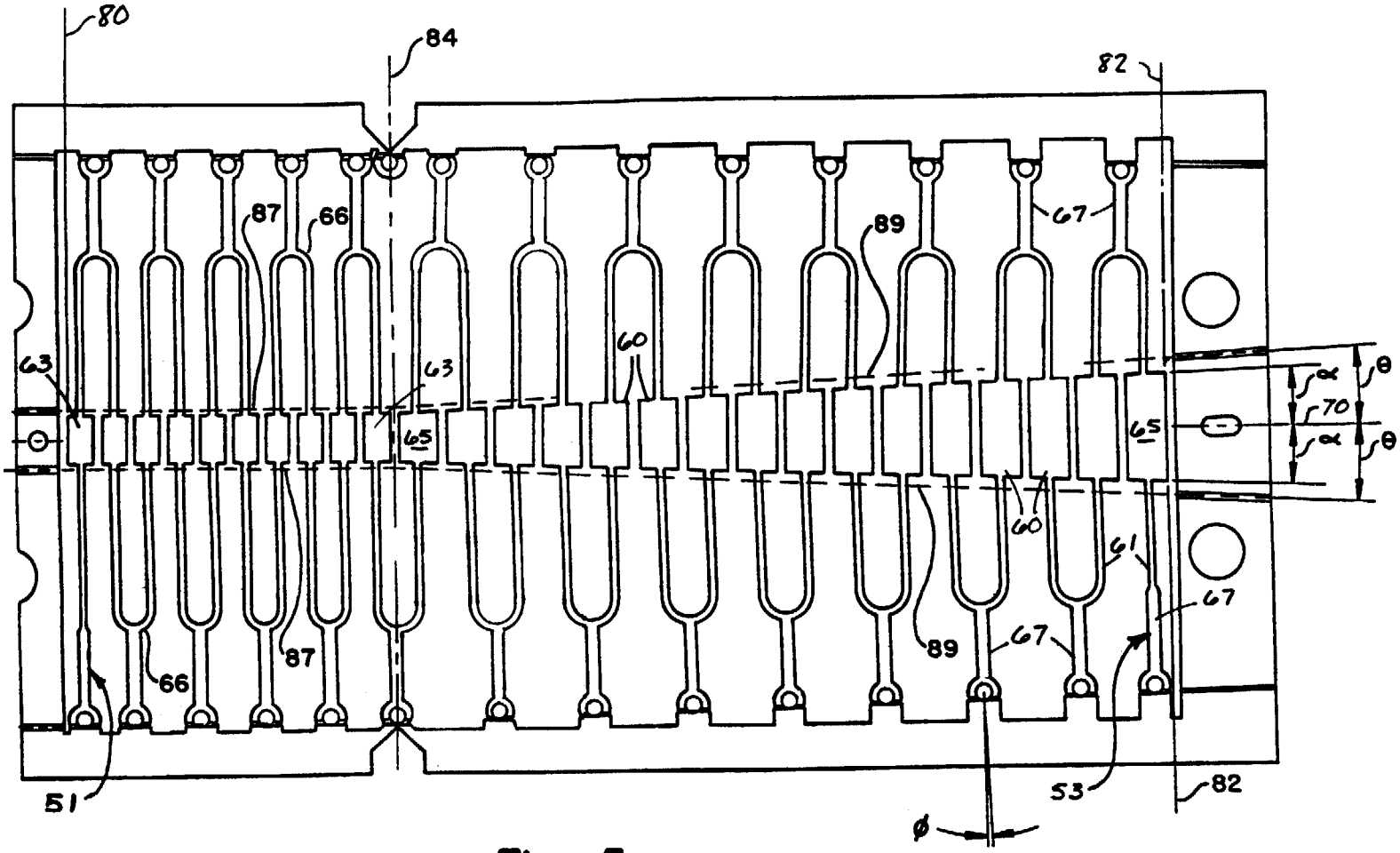
FIG. 5 is an enlarged plan view of shaped metal sheet used to form a meanderline deflection member.

Referring now to FIGS. 2, 3 and 4, vertical deflection structure 10 includes an opposed pair of serpentine deflection members 50, each directly supported by a pair of glass support rods 52. Rods 52 also serve as the principal support means for electron gun 22, as shown in FIG. 1, and for horizontal deflection plates 26. Each deflection member includes an input end 51 and an output end 53, which are connected by suitable leads (not shown) to neck pins 46, 48, respectively. Deflection members 50 are formed in a conventional manner, such as by etching or stamping, from a thin metal sheet. A sheet metal blank for one of the members is shown in FIG. 5.

Still referring to FIGS. 2–5, each deflection member 50 includes a plurality of deflection plate segments 60 electrically connected in series and supported in structure 10 by narrow interconnecting strips 61 that together with the plate segments form a serpentine meanderline. In the illustrated embodiment, each member has a total of twenty-six plate segments 60, including ten rectangular segments 63 of relatively similar size and sixteen trapezoidal segments 65 whose size increases progressively toward the output end of the member. For the purposes of individual identification, the plate segments will at times be referred to herein by a serial position number beginning with 60-1, the first rectangular segment 63 at the input end of the meanderline and continuing to 60-26, the final trapezoidal segment at the output end. For the sake of clarity, however, these identification numbers have been omitted from the drawings.

As is evident in the drawings, the interconnecting strips 61 at either end of the meanderline are essentially straight, while the remainder are in the form of U-shaped loops each of which interconnects two adjacent plate segments in the line. As will be understood, strips 61 provide the time delay that is required to synchronize vertical deflection signals traveling between the input and output ends of the deflection members with the electrons in the beam passing between those members in structure 10. The sections of the meanderline formed by plate segments 60 are of relatively low impedance because of their relatively large width, while the sections formed by the interconnecting strips are of much higher impedance. The strips 61 thus perform the additional function of raising the average impedance of the line to a value that can be driven economically. By way of explanation, vertical deflection signals in modern high frequency oscilloscope CRTs are provided by transistors, which are basically current sources. By maintaining a higher line impedance, a given deflection voltage can be obtained with less input current. This allows the use of less expensive transistors and reduces overall costs.

Integrally joined to the laterally outermost extent of each interconnecting strip 61 is a mounting portion 67. Portions 67, which are significantly wider than strips 61 (suitably about twice as wide), are directly joined to glass rods 52 for support of deflection member 50 in vertical deflection structure 10.

Referring now to FIGS. 1, 2 and 4, it will be seen that in the completed deflection structure members 50 are disposed with their plate segments 60 in spaced, mirror-image opposition. The interconnecting strips of each member angle away from those of the opposite member, suitably at about 45° from the horizontal in the exemplified structure, so that the mounting portions of each member's strips intercept that member's support rods 52. It will also be seen that each plate segment 60 in a first group at the input end of each deflection member is spaced a uniform distance from the corresponding segment in the opposite member. The first ten plate segments, i.e., segments 60-1 through 60-10, are uniformly spaced in structure 10. Beginning with plate segments 60-11, the spacing between each succeding opposed pair increases progressively toward the output end of the structure. Rectangular segments 63 form the first, uniformly spaced-apart group, and trapezoidal segments 65 form the second, divergent group.

The following specific example is given for purposes of illustration. Referring to FIG. 5, a 0.01 in. thick stainless steel sheet metal blank for a deflection member 50 is seen to include twenty-six elongate plate segments 60 disposed side-by-side in edge parallel relation along the blank's longitudinal centerline 70. The overall length of the member is about 2.512 in. as measured between datum lines 80 and 82 defining its input (or entrance) and output (or exit) ends. The plate segments are laterally centered on centerline 70, spaced apart about 0.021 in. The widths of the segments as measured along the blank's centerline is given in Table 1.

TABLE 1

| Segment # | Width | Segment # | Width |
|---|---|---|---|
| 60-1 | 0.037 in. | 60-14 | 0.080 in. |
| 60-2 | 0.048 | 60-15 | 0.082 |
| 60-3 | 0.057 | 60-16 | 0.086 |
| 60-4 | 0.057 | 60-17 | 0.089 |
| 60-5 | 0.058 | 60-18 | 0.097 |
| 60-6 | 0.059 | 60-19 | 0.099 |
| 60-7 | 0.060 | 60-20 | 0.104 |
| 60-8 | 0.060 | 60-21 | 0.104 |
| 60-9 | 0.060 | 60-22 | 0.102 |
| 60-10 | 0.060 | 60-23 | 0.102 |
| 60-11 | 0.060 | 60-24 | 0.101 |
| 60-12 | 0.066 | 60-25 | 0.097 |
| 60-13 | 0.072 | 60-26 | 0.090 |

The ten rectangular plate segments 63 each have a length of about 0.110 in. Beginning at datum line 84, where the deflection member is bent to provide increasing spacing between the trapezoidal segments in the completed structure, the length of segments 65 increases in accordance with an angle $\alpha$, which herein is equal to about 2.29° relative to centerline 70. The size of the trapezoidal plate segments is varied to compensate for the increasing spacing between them in deflection structure 10 and thus provide a reasonably uniform electrical field between them and an average impedance matching that of the non-divergent portion of the structure. The segment's size may also be varied to compensate for the effects of other CRT deflection system components, such as shields, on the electrical field between the two deflection members in structure 10.

The lengths of interconnecting strips 61 are determined by the amount of signal delay required to synchronize the deflection signals and beam electrons. The interconnecting strips in the exemplified deflection member have a width of about 0.015 in. and are joined to the ends of each segment along its longitudinal midline. The U-shaped loops joining plate segments 60-1 through 60-11 have leg lengths of about 0.328 in. From segments 60-11 through 60-26, the loops' leg lengths decrease progressively from about 0.328 to about 0.219 in. Each loop has a curved end portion with an inside radius equal to half the spacing between the legs. The integral mounting portions 67 joined to the interconnecting strips have a width of about 0.030 in. Between datum lines 84 and 82 the mounting portion and loop legs are tilted forward, i.e., toward datum line 82, at an angle $\phi$ of about 0.91° .This is to compensate for the slope of plate segments 60-11 through 60-26 in the finished deflection structure, so that all of the interconnecting strips and their mounting portions will be perpendicular to the CRT axis.

Prior to removal from its surrounding frame, deflection member 50 is bent along datum line 84 an amount related to the maximum vertical deflection required in CRT 11. In the exemplified embodiment, the portion of member 50 between datum lines 84 and 82 is bent to form an angle of about 3.20° relative to the portion between lines 80 and 84. Upon removal of the deflection member from the frame, the interconnecting strips are bent along dashed lines 87 and 89 to form an angle of about 45° between the strips and plate segments 60, as shown in FIG. 4. Lines 87 are about 0.060 in. from centerline 70, whereas the locations of lines 89 are defined by an angle $\theta$ of about 3.20° relative to the centerline. Following this, the deflection member is mounted along with another such member in a cathode-ray tube rodding fixture and the glass support rods (after being heated to their softening point) are thrust onto all of the mounting portions simultaneously. In normal practice, the rods are attached to all of the CRT gun and deflection elements at the same time, a technique that greatly reduces manufacturing costs yet provides a simple and sturdy structure.

A very significant savings in the cost of producing the meanderline vertical deflection structure results from the elimination of separate mounting structure for the line. In addition, it has been found that bending the interconnecting strips away from the beam axis increases the line's average impedance. As mentioned above, this allows the use of lower cost high frequency transistors to drive the line.

It will be noted that in the exemplified embodiment the length of interconnnecting strips 61 decreases toward the exit end of the structure. This causes some loss of synchronization between the deflection signals and beam electrons, which it would be preferable to avoid. In this case, the spacing between glass rods 52 was fixed by other tube parameters, making it necessary to reduce the lengths of the strips at the exit end of the meanderline.

We claim the following as our invention:

1. A deflection structure for a cathode-ray tube having means therein for producing a beam of electrons, said structure comprising a serpentine meanderline of conductive material along which deflection signals travel, said meanderline being formed by a plurality of plate segments disposed in spaced edge-to-edge relation in a row extending generally along the path of said beam and serially interconnected generally U-shaped strips of substantially narrower width, said strips extending angularly away from the plane of each segment, and means supporting the meanderline in said tube, said means comprising a pair of insulating rods extending in the direction of said path, one along each side of said row, and means for securing said strips to said rods.

2. The structure of claim 1, wherein said rods also support said electron beam-producing means in said tube.

3. The structure of claim 1, additionally comprising a second serpentine meanderline supported by an additional pair of insulating rods, said meanderlines being disposed in spaced relation on opposite sides of said path.

4. The structure of claim 1, wherein said strip securing means comprises an integral mounting portion on each strip, which portion directly engages one of said rods.

5. The structure of claim 4, wherein said rods are formed of glass and said mounting portions are pressed into the rods.

6. The structure of claim 1, wherein said strips extend away from the plane of each segment at an angle of about 45° .

7. The structure of claim 1, wherein said meanderline includes a first section in which certain plate segments lie in a plane extending parallel to said path, and a second section in which certain other plate segments lie in a plane extending at a shallow angle to said path.

8. A deflection structure for a cathode-ray tube having means therein for producing a beam of electrons, said structure comprising a pair of serpentine meanderlines of conductive material along which deflection signals travel, each of said meanderlines being formed by a plurality of plate segments disposed in spaced edge-to-edge relation in a row extending generally along the path of said beam and serially interconnected by generally U-shaped strips of substantially narrower width, said strips extending angularly away from the plane of each segment, and means supporting said meanderlines in spaced relation on opposite sides of said path, said means comprising for each meanderline a pair of insulating rods extending in the direction of said path, one along each side of the row of plate segments in said line, and means for securing the strips of each line to the insulating rods for said line.

9. The structure of claim 8, wherein said electron beam-producing means in said tube also is supported by said pairs of insulating rods.

10. The structure of claim 8, which structure includes a first portion in which the plate segments of the opposed meanderlines are spaced a uniform distance from said path, and a second portion in which said plate segments are spaced at progressively increasing distances from said path.

11. The structure of claim 10, wherein the plate segments in said first portion are of similar size, and wherein the plate segments in said second portion are of progressively increasing size.

* * * * *